US011271334B2

(12) United States Patent
Xu et al.

(10) Patent No.: US 11,271,334 B2
(45) Date of Patent: Mar. 8, 2022

(54) ELECTRICAL CONTACT

(71) Applicants: FOXCONN (KUNSHAN) COMPUTER CONNECTOR CO., LTD., Kunshan (CN); FOXCONN INTERCONNECT TECHNOLOGY LIMITED, Grand Cayman (KY)

(72) Inventors: De-Ming Xu, Kunshan (CN); Xiao-Bo Du, Kunshan (CN); Guo-Hua Zhang, Kunshan (CN); Zi-Qiang Zhu, Kunshan (CN)

(73) Assignees: FOXCONN (KUNSHAN) COMPUTER CONNECTOR CO., LTD., Kunshan (CN); FOXCONN INTERCONNECT TECHNOLOGY LIMITED, Grand Cayman (KY)

( * ) Notice: Subject to any disclaimer, the term of this patent is extended or adjusted under 35 U.S.C. 154(b) by 0 days.

(21) Appl. No.: 16/908,683

(22) Filed: Jun. 22, 2020

(65) Prior Publication Data

US 2020/0403331 A1 Dec. 24, 2020

(30) Foreign Application Priority Data

Jun. 20, 2019 (CN) ..... 201920930583.6

(51) Int. Cl.
*H01R 12/58* (2011.01)

(52) U.S. Cl.
CPC ..... *H01R 12/585* (2013.01)

(58) Field of Classification Search
CPC ..... H01R 13/6587; H01R 12/724; H01R 12/585; H01R 12/737; H01R 13/6585; H01R 13/514; H01R 13/6594; H01R 13/518; H01R 13/6471; H01R 13/6473; H01R 12/716; H01R 12/721; H01R 12/727; H01R 12/73; H01R 13/6205; H01R 13/6461; H01R 13/6474; H01R 13/6593; H01R 13/6599; H01R 43/205; H01R 43/24; H01R 12/7064; H01R 12/7082; H01R 12/7088; H01R 12/712; H01R 12/714;

(Continued)

(56) References Cited

U.S. PATENT DOCUMENTS 4,585,293 A 4/1986 Czeschka et al.
4,691,979 A 9/1987 Manska (Continued)

*Primary Examiner* — Truc T Nguyen
(74) *Attorney, Agent, or Firm* — Ming Chieh Chang; Wei Te Chung

(57) ABSTRACT

An electrical contact for extending through a hole in the printed circuit board in an insertion direction, includes a retention plate and a leg extending therefrom. The leg includes an insertion section and a deformation section. The deformation section includes a pair of opposite wide side faces in a first direction perpendicular to the insertion direction, and a pair of opposite narrow side faces in a second direction perpendicular to both the insertion direction and the first direction, and a cavity recessed from one wide side face in the first direction. The cavity forms a first end located closer to the insertion end of the leg in the insertion direction and equipped with a cone shape thereof, and a second end located opposite to the first end and closer to a rectangular retention section and equipped with an arc shape thereof. The cavity forms a trapezoidal cross-section.

11 Claims, 4 Drawing Sheets

(58) Field of Classification Search
CPC ..... H01R 12/79; H01R 13/025; H01R 13/03; H01R 13/2421; H01R 13/658; H01R 13/6581; H01R 13/6582; H01R 13/6586; H01R 13/6598; H01R 2107/00; H01R 24/60; H01R 4/023; H01R 9/24; H01R 12/51; H01R 12/523; H01R 12/53; H01R 12/55; H01R 12/57; H01R 12/58; H01R 12/7052; H01R 12/707; H01R 12/7076; H01R 12/735; H01R 12/75; H01R 12/91; H01R 13/04; H01R 13/112; H01R 13/2435; H01R 13/2442; H01R 13/245; H01R 13/2464; H01R 13/40; H01R 13/405; H01R 13/4538; H01R 13/46; H01R 13/502; H01R 13/506; H01R 13/516; H01R 13/5202; H01R 13/5213; H01R 13/5219; H01R 13/53; H01R 13/585; H01R 13/627; H01R 13/6272; H01R 13/64; H01R 13/6477; H01R 13/652; H01R 13/6589; H01R 13/6591; H01R 13/6592; H01R 13/665; H01R 2201/26; H01R 24/20; H01R 25/006; H01R 33/94; H01R 43/005; H01R 43/007; H01R 43/02; H01R 43/0221; H01R 43/20; H01R 43/28; H01R 4/02; H01R 4/029; H01R 4/26; H01R 4/4818; H01R 4/58; H01R 9/2408
See application file for complete search history.

(56) References Cited

U.S. PATENT DOCUMENTS

| | | | | |
|---|---|---|---|---|
| 4,795,378 | A | 1/1989 | Tomizu et al. | |
| 4,831,728 | A | 5/1989 | Barnhouse | |
| 5,667,412 | A | 9/1997 | Takahashi et al. | |
| 5,738,550 | A | 4/1998 | Sakuraoka et al. | |
| 6,231,402 | B1 * | 5/2001 | Kikuchi | H01R 12/585 439/751 |
| 6,305,949 | B1 | 10/2001 | Okuyama et al. | |
| 6,722,928 | B1 * | 4/2004 | Noda | H01R 12/585 439/751 |
| 8,092,262 | B1 * | 1/2012 | Frederick | H01R 12/585 439/751 |
| 9,276,338 | B1 * | 3/2016 | Dariavach | H01R 12/585 |
| 9,472,877 | B1 * | 10/2016 | Hoffmeyer | H01R 43/205 |
| 2004/0242033 | A1 * | 12/2004 | Hu | H01R 12/585 439/82 |
| 2006/0264076 | A1 * | 11/2006 | Chen | H01R 12/585 439/82 |
| 2010/0022137 | A1 * | 1/2010 | Mcalonis | H01R 13/052 439/638 |
| 2014/0099839 | A1 * | 4/2014 | Trout | H01R 12/585 439/817 |
| 2019/0131723 | A1 * | 5/2019 | Txarola | H01R 12/585 |
| 2019/0280406 | A1 * | 9/2019 | Zhang | H01R 12/585 |

* cited by examiner

ELECTRICAL CONTACT

BACKGROUND OF THE INVENTION

1. Field of the Invention

The present invention relates generally to an electrical contact for retention within a through hole in the printed circuit board.

2. Description of Related Arts

Miniaturization is a trend for the contact used within an electrical connector, and, a required strength and a desired resiliency of the contact for retention within a through hole in the printed circuit board, is a key issue of the contact design. Anyhow, the former requires the relatively thick structure while the latter requires the relatively thin structure, thus conflicting each other.

It is desired to provide a contact design with a specific configuration to obtain a balance between the rigidity and resiliency thereof.

SUMMARY OF THE INVENTION

To achieve the above object, an electrical contact for extending through a hole in the printed circuit board in an insertion direction, and being retained therein, includes a retention plate and a leg extending therefrom. The leg includes an insertion section and a deformation section wherein the deformation section includes a pair of opposite wide side faces in a first direction perpendicular to the insertion direction, and a pair of opposite narrow side faces in a second direction perpendicular to both the insertion direction and the first direction, and a cavity recessed from one wide side face in the first direction. The cavity forms a first end located closer to the insertion end of the leg in the insertion direction and equipped with a cone shape thereof, and a second end located opposite to the first end and closer to a rectangular retention section and equipped with an arc shape thereof. The cavity forms a trapezoidal cross-section. The thickness of the deformation section has a first thickness in the first direction, and a second thickness in the second direction, the first thickness being smaller than the second thickness.

Other advantages and novel features of the invention will become more apparent from the following detailed description of the present embodiment when taken in conjunction with the accompanying drawings.

DETAILED DESCRIPTION OF THE PREFERRED EMBODIMENT

Figure 1:
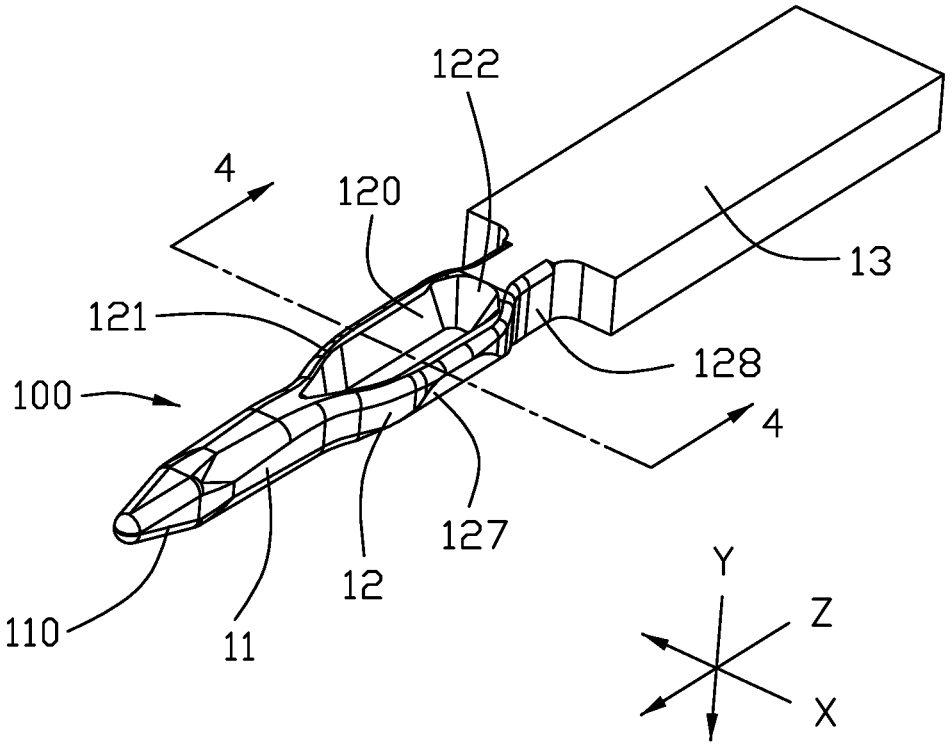
FIG. 1 is a perspective view of an electrical contact according to the invention.
Figure 2:
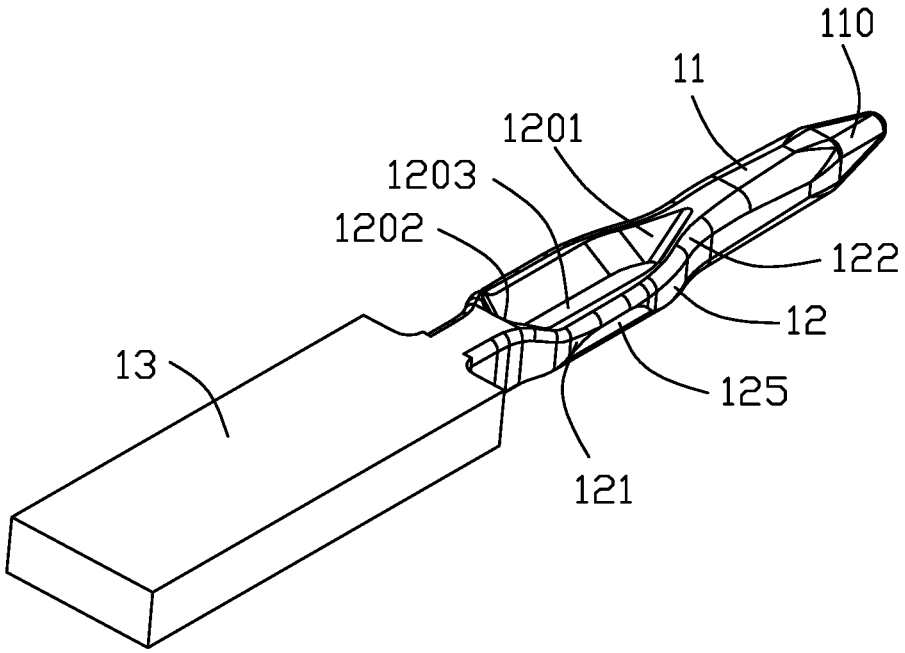
FIG. 2 is another perspective view of the electrical contact of FIG. 1.
Figure 3:
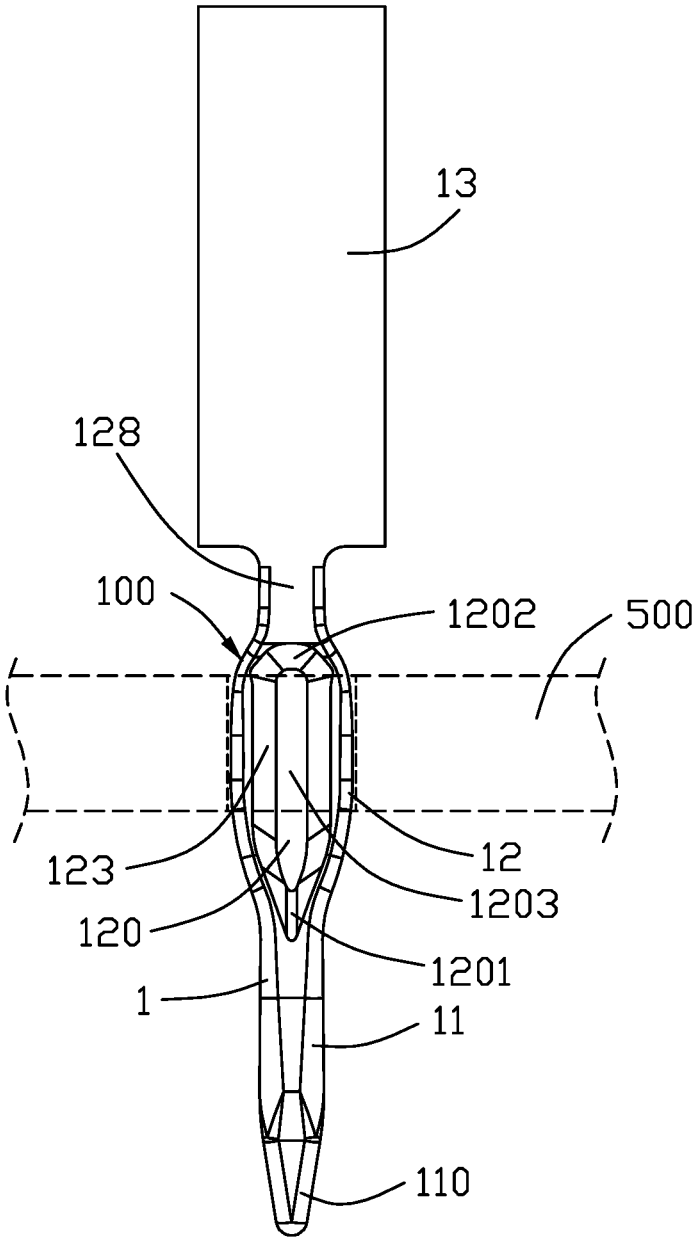
FIG. 3 is an elevational view of the contact of FIG. 1.

An electrical contact 100 for use within an electrical connector (not shown) and mounting into a through hole of a printed circuit board 500, includes a retention section/plate 13 and a leg 1 extending downwardly from the retention section 13 in an insertion direction Z. The leg includes an insertion section 11 closer to the free end of the leg 1, and a deformation section 12 closer to the retention section 13. The deformation section includes a pair of opposite wide side faces 121 in a first direction Y perpendicular to the insertion direction Z, and a pair of opposite narrow side faces 122 in a second direction X perpendicular to both the insertion direction Z and the first direction Y. A cavity 120 is recessed from one wide side face 121 and includes a first end 1201 closer to the insertion section 11, and a second end opposite to the first end in the insertion direction and closer to the retention section 13. In a top view taken along the first direction Y, the first end 1201 forms a cone configuration while the second end 1202 forms an arc configuration. Understandably, the cone configuration of the first end 1201 facilitates insertion of the leg 1, and the arc configuration of the second end 1202 may provide sufficient retention force of the deformation section 12 within the hole of the printed circuit board.

The cavity 120 includes a middle region 1203 between the first end 1201 and the second end 1202. The cross-section of the middle region 1203 of the cavity 120 forms a trapezoidal configuration wherein the bottom of cavity 120 has a dimension less than that of the top of the cavity 120 in the second direction. In other words, the cavity 120 forms a bell mouth configuration opening to an exterior in the first direction Y.

The deformation section 12 includes a pair of side portions 125 by two sides of the cavity 120 in the second direction, and a bottom portion 126 under the cavity 120 in the first direction Y. The bottom portion 126 extends in a planar manner while the side portion 125 extends from the bottom portion 126 in an oblique manner. Therefore, the cross-section of the side portion 125 forms a wedged configuration. The thickness of the bottom portion (in the first direction Y) is smaller than that of the side portions 125 (in the second direction X), thus increasing resiliency of the deformation section 12.

The deformation section 12 includes external surfaces 127 opposite to the cavity 120. Each exterior surface 127 forms a recess 1270 at a corner with the bottom portion 126. Each side portion 125 includes a first convex 1251 adjacent to the recess 1270 and a second convex 1252 opposite to the first convex 1251 *n* the first direction Y and adjacent to an opening of the cavity 120. The pair of first convexes 1251 and the pair of convexes 1252 both abut against an interior surface of the through hole of the printed circuit board 500.

Figure 4:
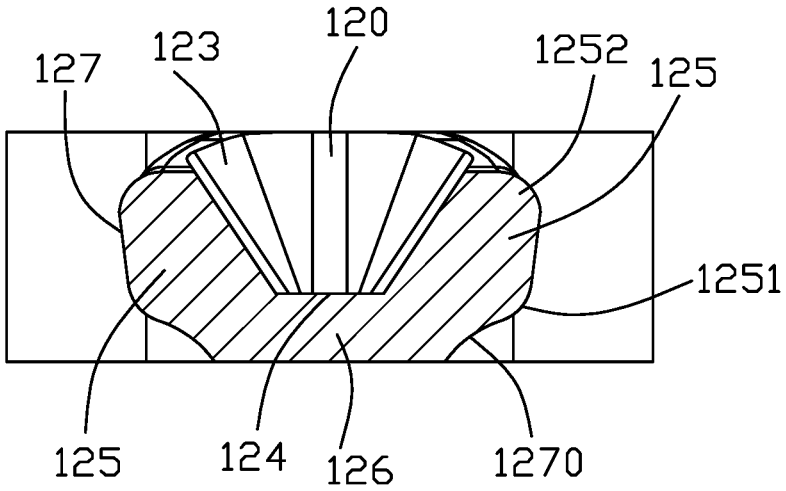
FIG. 4 is a cross-sectional view of the electrical contact of FIG. 1.

The insertion section 11 includes a tail end 110 with a tapered configuration for easy insertion. The retention section 13 is dimensioned to be wider than the deformation section 12. The deformation section 12 further includes a neck 128 around the second end 1202 of the cavity 120. As shown in FIG. 4, the exterior surface 127 of the left side portion 125 is not parallel to the exterior surface 127 of the right side portion 125 in symmetry with regard to a centerline of the leg extending along the first direction.

Although the present invention has been described with reference to particular embodiments, it is not to be construed as being limited thereto. Various alterations and modifications can be made to the embodiments without in any way departing from the scope or spirit of the present invention as defined in the appended claims.

What is claimed is:

1. A contact for use within a through hole of a printed circuit board comprising:

a retention section;

a leg extending from the retention section along an insertion direction, and including an insertion section and a deformation section located between the insertion section and the retention section, said deformation section including a pair of wide side faces opposite to each other in a first direction perpendicular to the insertion direction, and a pair of narrow side faces opposite to each other in a second direction;

a cavity formed in the deformation section and recessed, in the first direction, from one wide side face with a trapezoidal cross-section and a bell mouth opening to an exterior in the first direction; wherein the deformation section includes a bottom portion under the cavity in the first direction, and a pair of side portions beside the cavity in the second direction, the pair of side portions being located above the bottom portion;

a thickness of the bottom portion in the first direction is smaller than that of the side portions in the second direction; and a pair of recesses are formed around corners of the side portions and the bottom portion.

2. The contact as claimed in claim 1, wherein in a cross-sectional view, each side portion forms a first convex and a second convex on an exterior surface and spaced from each other in the first direction and adapted to be engaged within the through hole of the printed circuit board.

3. The contact as claimed in claim 1, wherein exterior surfaces of the pair of side portions are not parallel to each other but in symmetry with respect to a centerline of the leg.

4. The contact as claimed in claim 1, wherein the cavity defines, along the insertion direction, a first end adjacent to the insertion section, and a second end opposite to the first end and adjacent to the retention section, and the first end defines a cone configuration while the second end defines an arc configuration.

5. The contact as claimed in claim 1, wherein the deformation section is wider than the insertion section while is narrower than the retention section in the second direction.

6. The contact as claimed in claim 5, wherein a neck section is formed between the deformation section and the retention section in the insertion direction, and defines a width similar to that of the insertion section in the second direction.

7. An electrical contact for use within a through hole of a printed circuit board, comprising:

a retention section;

a leg extending from the retention section along an insertion direction, and including an insertion section and a deformation section located between the insertion section and the retention section, said deformation section including a pair of wide side faces opposite to each other in a first direction perpendicular to the insertion direction, and a pair of narrow side faces opposite to each other in a second direction; wherein a cavity formed in the deformation section and recessed, in the first direction, from one wide side face; wherein the cavity defines, along the insertion direction, a first end adjacent to the insertion section, and a second end opposite to the first end and adjacent to the retention section, and the first end defines a cone configuration while the second end defines an arc configuration;

the deformation section includes a bottom portion under the cavity in the first direction, and a pair of side portions beside the cavity in the second direction, the pair of side portions being located above the bottom portion;

in a cross-sectional view, each side portion forms a first convex and a second convex on an exterior surface and spaced from each other in the first direction and adapted to be engaged within the through hole of the printed circuit board; and a pair of recesses are formed around corners of the side portions and the bottom portion.

8. The contact as claimed in claim 7, wherein a thickness of the bottom portion in the first direction is smaller than that of the side portions in the second direction.

9. The contact as claimed in claim 7, wherein exterior surfaces of the pair of side portions are not parallel to each other but in symmetry with respect to a centerline of the leg.

10. A contact for use within a through hole of a printed circuit board comprising:

a retention section;

a leg extending from the retention section along an insertion direction, and including an insertion section and a deformation section located between the insertion section and the retention section, said deformation section including a pair of wide side faces opposite to each other in a first direction perpendicular to the insertion direction, and a pair of narrow side faces opposite to each other in a second direction;

a cavity formed in the deformation section and recessed, in the first direction, from one wide side face; wherein the deformation section includes a bottom portion under the cavity in the first direction, and a pair of side portions beside the cavity in the second direction; wherein exterior surfaces of the pair of side portions are not parallel to each other but in symmetry with respect to a centerline of the leg; wherein a pair of recesses are formed around corners of the side portions and the bottom portion.

11. The contact as claimed in claim 10, wherein in a cross-sectional view, each side portion forms a first convex and a second convex on an exterior surface and spaced from each other in the first direction and adapted to be engaged within the through hole of the printed circuit board.

* * * * *